US008332992B2

(12) United States Patent
Landmesser

(10) Patent No.: US 8,332,992 B2
(45) Date of Patent: Dec. 18, 2012

(54) DEVICE AT A CARD FOR COTTON, SYNTHETIC FIBRES AND THE LIKE, IN WHICH AT LEAST ONE FLAT BAR HAVING A FLAT CLOTHING IS PRESENT

(75) Inventor: Thomas Landmesser, Erkelenz (DE)

(73) Assignee: Truetzschler GmbH & Co. Kg, Moenchengladbach (DE)

( * ) Notice: Subject to any disclaimer, the term of this patent is extended or adjusted under 35 U.S.C. 154(b) by 1455 days.

(21) Appl. No.: 11/471,580

(22) Filed: Jun. 21, 2006

(65) Prior Publication Data

US 2007/0006424 A1 Jan. 11, 2007

(30) Foreign Application Priority Data

Jun. 24, 2005 (DE) ..... 10 2005 029 766
Feb. 6, 2006 (DE) ..... 10 2006 005 605

(51) Int. Cl.
*D01G 15/00* (2006.01)

(52) U.S. Cl. ..... 19/98

(58) Field of Classification Search ..... 19/102, 19/113, 114, 98, 145.7
See application file for complete search history.

(56) References Cited

U.S. PATENT DOCUMENTS

| | | | | |
|---|---|---|---|---|
| 5,819,383 | A * | 10/1998 | Jourde et al. | 28/107 |
| 7,318,253 | B2 * | 1/2008 | Elsasser et al. | 19/114 |
| 2002/0129467 | A1 | 9/2002 | Leder | |
| 2005/0044667 | A1 | 3/2005 | Elsasser et al. | |

FOREIGN PATENT DOCUMENTS

| | | | |
|---|---|---|---|
| DE | 25 44 517 | A1 | 4/1977 |
| DE | 195 08 748 | A1 | 9/1996 |
| DE | 100 07 268 | C2 | 9/2001 |
| DE | 203 20 538 | U1 | 11/2004 |
| DE | 10 2004 033 509 | A1 | 3/2005 |
| EP | 0 403 111 | A1 | 12/1990 |
| GB | 2 032 477 | A | 5/1980 |

OTHER PUBLICATIONS

International Search Report dated Oct. 17, 2006 issued in GB 0612231.1.

* cited by examiner

*Primary Examiner* — Tejash Patel

(74) *Attorney, Agent, or Firm* — Venable LLP; Robert Kinberg; Steven J. Schwarz

(57) ABSTRACT

In a device at a card in which at least one flat bar having a flat clothing is present, wherein the flat clothing, preferably small wire hooks, arranged in a strip-shaped supporting layer, is attached to the flat bar and lies opposite to the clothing of a roller, for example of the cylinder, and at least the regions of the flat clothing that face the flat bar consist of an iron material, especially of steel, there is present between the flat bar and the regions of the flat clothing that face the flat bar at least one magnetic element. In order to increase the degree of adhesive forces between flat bar and clothing element in a structurally simple manner, the supporting body of the clothing strip comprises a sheet-like structure that consists at least in part of a ferromagnetic material.

21 Claims, 4 Drawing Sheets

DEVICE AT A CARD FOR COTTON, SYNTHETIC FIBRES AND THE LIKE, IN WHICH AT LEAST ONE FLAT BAR HAVING A FLAT CLOTHING IS PRESENT

CROSS REFERENCE TO RELATED APPLICATION

This application claims priority from German Patent Application No. 10 2005 029 766.8 dated Jun. 24, 2005, and German Patent Application No. 10 2006 005 605.1 dated Feb. 6, 2006, the entire disclosure of each of which is incorporated herein by reference.

BACKGROUND OF THE INVENTION

The invention relates to a device at a card for cotton, synthetic fibres and the like, in which at least one flat bar having a flat clothing is present, wherein the flat clothing, preferably small wire hooks, which is arranged in a strip-shaped supporting layer, is attached to the flat bar and lies opposite to the clothing of a roller, for example of the cylinder, and at least the regions of the flat clothing that face the flat bar consist of an iron material, especially of steel.

A device of that kind, in which there is present between the flat bar and the regions of the flat clothing that face the flat bar at least one magnetic element, is known from DE 10 2004 033 509A.

It is an aim of the invention to improve such a device by substantially increasing the degree of the attachment forces between flat bar and clothing element in a structurally simple manner.

SUMMARY OF THE INVENTION

The invention provides a flexible clothing for a card flat, comprising an elongate supporting body; and clothing elements arranged in the supporting body;

wherein the clothing further comprises a structure comprising a ferromagnetic material.

By virtue of the fact that the supporting layer for the clothing element comprises a said structure comprising ferromagnetic material, the face for the attachment of the clothing element, which face lies opposite to the magnet, is substantially enlarged, with the result that the adhesive forces are appreciably increased. A particular advantage is that the structure, which is preferably sheet-like, is connectable to the supporting layer at the stage at which the clothing strip is produced. Thus, in a preferred embodiment, the through-piercing by the small clothing hooks results in the supporting layer, and with it the sheet-like structure, being needled together. The magnetic connection and thus the attachment of the clothing strip to the flat bar is surprisingly good. When applied to a spinning mill, a simple system of connection in the region of the flat is thereby created, which renders possible a quick and easy re-clothing that can be carried out in the spinning mill without the need for greater tool expenditure. Especially in the event of the flat clothings becoming worn, the clothing strips, which, for example, lie ready in store, can be replaced in a simple manner during operation. A high attachment force, with simple and rapid replaceability of the clothing strips, is provided in accordance with the invention.

The structure may be a woven fabric, which is preferably fine-meshed. The structure may be a sheet or the like. Advantageously, the sheet-like structure is flexible. Advantageously, the sheet-like structure is thin. Advantageously, the sheet-like structure comprises fine wires. The structure may be portions of wire. The structure may be particles, for example, powder. Advantageously, the structure is aligned substantially parallel to the magnetic element. Advantageously, the structure is aligned substantially parallel to the foot face of the flat bar.

Advantageously, the structure is integrated into the supporting body. The structure may form an intermediate layer of the supporting body. The structure may form the top layer of the supporting body, which layer faces the magnet. The structure may have been incorporated into the supporting body. Advantageously, the structure has been applied to the supporting body.

Advantageously, the structure arranged in or on the supporting body is punched through by the clothing wires, preferably small wire hooks. Advantageously, the structure arranged in or on the supporting body is needled by the clothing wires, preferably small wire hooks. Advantageously, the regions of the clothing that face the flat bar, especially crosspieces (backs) of the U-shaped wires or the like, and of the structure forming the top layer, have an approximated height.

Advantageously, the structure is interwoven into the supporting body, for example of cotton. Advantageously, the structure is embedded in the supporting body. The structure may be a sheet-metal foil. The structure may be a woven sheet-metal fabric. Advantageously, the supporting body is flexible. The supporting body and the structure may be joined to one another by adhesive bonding or the like. The supporting body and the structure may be joined to one another by sewing.

Advantageously, the ferromagnetic material is steel.

Advantageously, the clothing is attached to a card flat bar having a magnetic element, and at least part of the magnetic element is in contact with the crosspiece (back) of the U-shaped wires. Advantageously, at least part of the magnetic element is in contact with the sheet-like structure.

The invention also provides a flat bar for a card for cotton, synthetic fibres and the like, having a flat clothing, wherein the flat clothing, preferably small wire hooks, which is arranged in a strip-shaped supporting layer, is attached to the flat bar, and at least the regions of the flat clothing that face the flat bar consist of an iron material, especially of steel, there being present between the flat bar and the regions of the flat clothing that face the flat bar at least one magnetic element, wherein the supporting body of the clothing strip comprises a sheet-like structure that consists at least in part of a ferromagnetic material.

Furthermore, the invention provides flexible clothing for a flat bar at a card for cotton, synthetic fibres and the like, having a flat clothing, wherein the flat clothing, preferably small wire hooks, which is arranged in a strip-shaped supporting layer, is attachable to the flat bar, and at least the regions of the flat clothing that are to face the flat bar consist of an iron material, especially steel, in which the supporting body of the clothing strip comprises a sheet-like structure that consists at least in part of a ferromagnetic material. Moreover, the invention provides a card having a revolving card top unit for cotton, synthetic fibres and the like, in which at least one flat bar having a flat clothing is present, wherein the flat clothing, preferably small wire hooks, which is arranged in a strip-shaped supporting layer, is attached to the flat bar and lies opposite to the clothing of a roller, for example of the cylinder, and at least the regions of the flat clothing that face the flat bar consist of an iron material, especially of steel, there being present between the flat bar and the regions of the flat clothing that face the flat bar at least one magnetic element, in which the supporting body of the clothing strip comprises a sheet-like structure that consists at least in part of a ferromagnetic material.

The invention also provides a device at a card for cotton, synthetic fibres and the like, in which at least one flat bar having a flat clothing is present, wherein the flat clothing, preferably small wire hooks, which is arranged in a strip-shaped supporting layer, is attached to the flat bar and lies opposite to the clothing of a roller, for example of the cylinder, and at least the regions of the flat clothing that face the flat bar consist of an iron material, especially of steel, there being present between the flat bar and the regions of the flat clothing that face the flat bar at least one magnetic element, in which the supporting body of the clothing strip comprises a sheet-like structure that consists at least in part of a ferromagnetic material.

DESCRIPTION OF CERTAIN PREFERRED EMBODIMENTS

Figure 1:
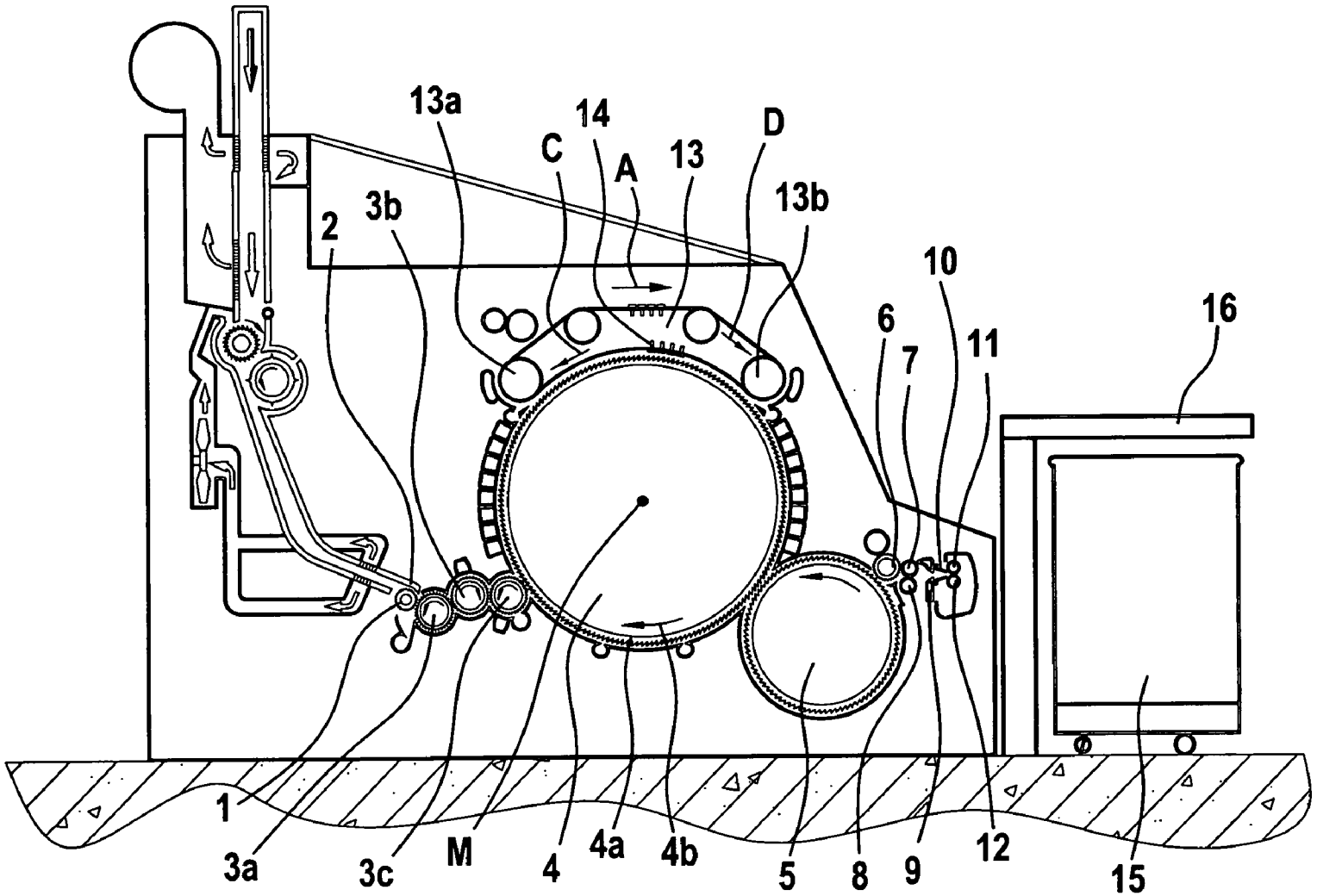
FIG. 1 is a diagrammatic side view of a card having a device according to the invention.

FIG. 1 shows a card, for example a TC 03 (trade mark) card made by Trutzschler GmbH & Co. KG of Mönchengladbach, Germany, having a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers 11, 12, revolving card top 13 having card-top-deflecting rollers 13*a*, 13*b* and flat bars 14, can 15 and can coiler 16. Curved arrows indicate the directions of rotation of the rollers. M indicates the centre (axis) of the cylinder 4. 4*a* indicates the clothing and 4*b* indicates the direction of rotation of the revolving card top 13 in carding position and D indicates the return transport direction of the flat bars 14.

Figure 2:
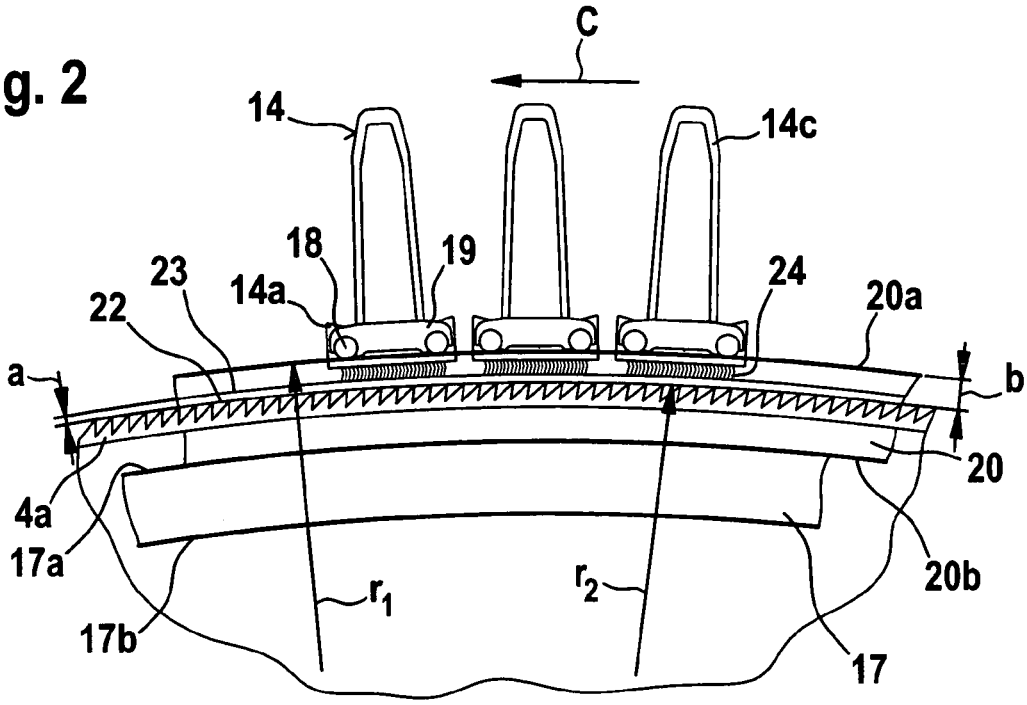
FIG. 2 is a side view of a number of flat bars with a portion each of a slideway and of a flexible bend.

According to FIG. 2, at each side a flexible bend 17 is attached to the machine frame at the side by screws, the flexible bend having a plurality of setting screws. The flexible bend 17 has a convex outer face 17*a* and a lower face 17*b*. Above the flexible bend 17 there is a slideway 20, for example of anti-friction plastics, which has a convex outer face 20*a* and a concave inner face 20*b*. The concave inner face 20*b* lies on the convex outer face 17*a*. The flat bars 14, which are of extruded aluminium, have a supporting body 14*c* and have at each of their two ends a flat foot 14*a* to which there are attached in the axial direction two steel pins 18, which slide on the convex outer face 20*a* of the slideway 20 in the direction of the arrow C. Attached to the lower face of the flat foot 14*a* is the flat clothing 24. 23 indicates the circle of tips of the flat clothings 24.

The cylinder 4 has a cylinder clothing 4*a*, for example saw-tooth clothing, on its circumference. The circle of tips of the cylinder clothing 4*a* is indicated by 22. The spacing between the circle of tips 23 and the circle of tips 22 is indicated by a and is, for example, 2/1000". The spacing between the convex outer face 20*a* and the circle of tips 22 is indicated by b. The variable radius of the convex outer face 20*a* is indicated by $r_1$ and the constant radius of the circle of tips 22 is indicated by $r_2$. The radius $r_2$ intersects the centre M (see FIG. 1) of the cylinder 4. The back of the card flat is indicated by 14*c*. 19 indicates a clamping element that engages around the flat pins 18 and is connected to the drive belt (not shown) for the flat bars 14.

Figure 3:
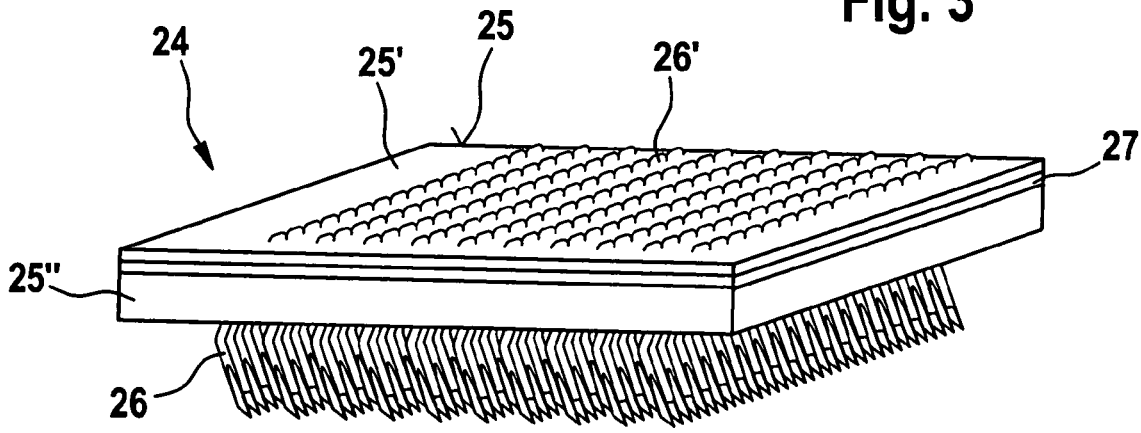
FIG. 3 is a perspective view of a clothing strip with supporting element and small wire hooks, in which a sheet-metal foil is present as intermediate layer in the supporting element.

In the embodiment of FIG. 3, the flat clothing 24 consists of clothing tips 26 (small wire hooks) and a supporting element 25 consisting of a layered body 25" of textile material. The small wire hooks 26 are of approximately U-shaped form and, punched through the face 25', are fastened in the supporting element 25. The turn regions 26' of the small wire hooks 26 project beyond the face 25'. The ends of the small wire hooks 26, the clothing tips, are free. The small wire hooks 26 consist of steel wire. A thin, fine-meshed, flexible woven steel fabric 27 is interwoven in the supporting body as an intermediate layer. It is also possible (in a manner not shown) for a thin flexible sheet-steel foil 28 of the kind shown in FIG. 4 to be interwoven as intermediate layer.

Figure 4:
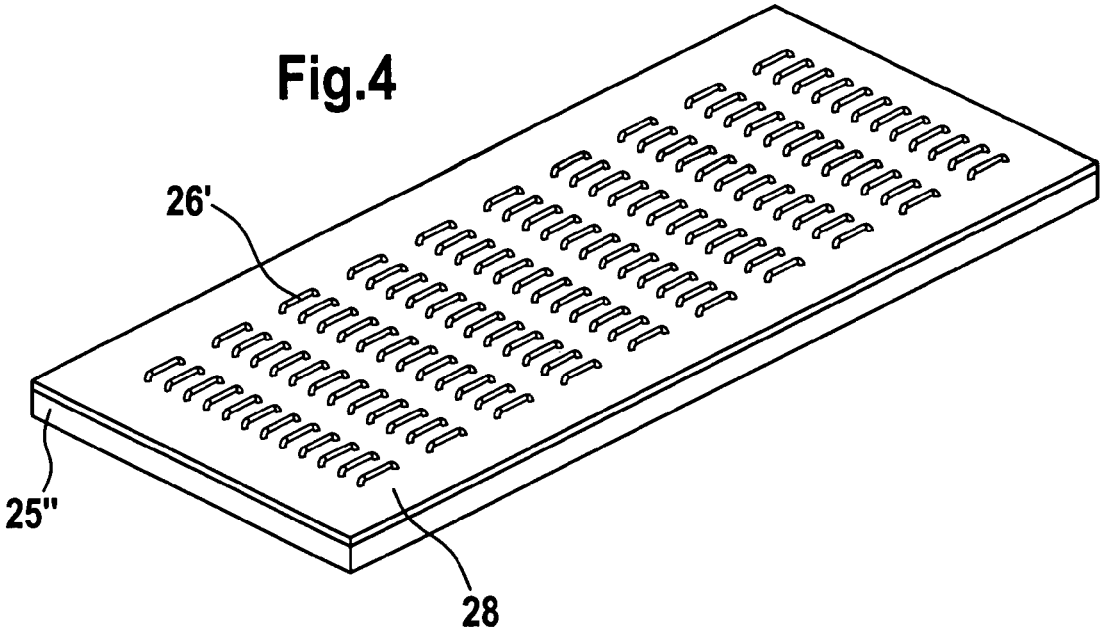
FIG. 4 is a perspective view of the rear side of another clothing strip with sheet-metal foil which, as top layer, is needled on and to the supporting element by the small wire hooks.

In the embodiment of FIG. 4, in the production of the clothing strip 25, a thin, flexible sheet-steel foil 28 is applied as a top layer onto the supporting body 25". The sheet-steel foil 28 and the supporting body 25" are then needled together by the through-piercing small wire hooks 26. The approximately arch-shaped small wire hooks 26' project slightly beyond the sheet-steel foil 28.

Figure 5:
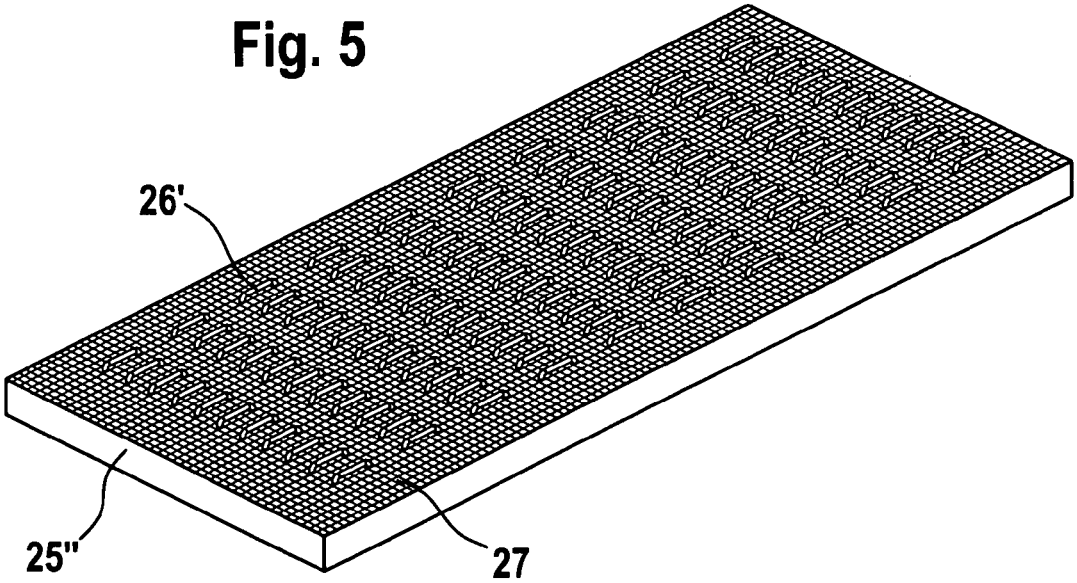
FIG. 5 shows an embodiment similar to that of FIG. 4 but in which a woven steel-wire fabric is needled on and to the supporting element by the small wire hooks.

In a further embodiment shown in FIG. 5, instead of the sheet-steel foil according to FIG. 4, a thin, fine-meshed and flexible woven steel fabric 27 is attached as a top layer onto the supporting body 25" by pinning with the small clothing hooks 26.

Figure 6A:
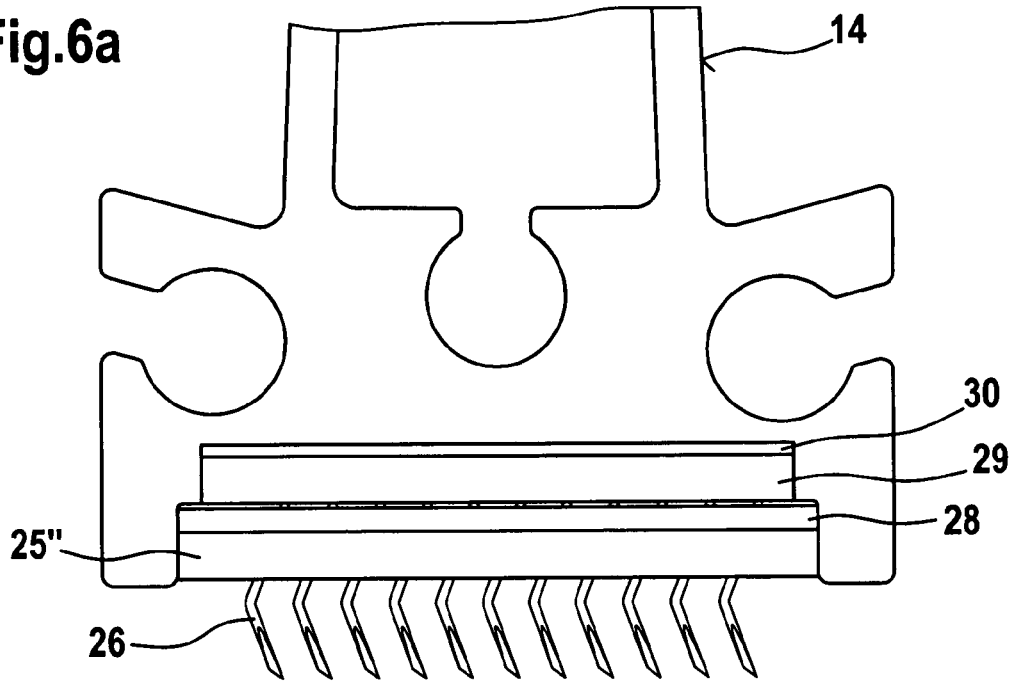
FIG. 6*a* shows a flat bar having magnetic and clothing strips (small wire hook clothing) and in the assembled state.
Figure 6B:
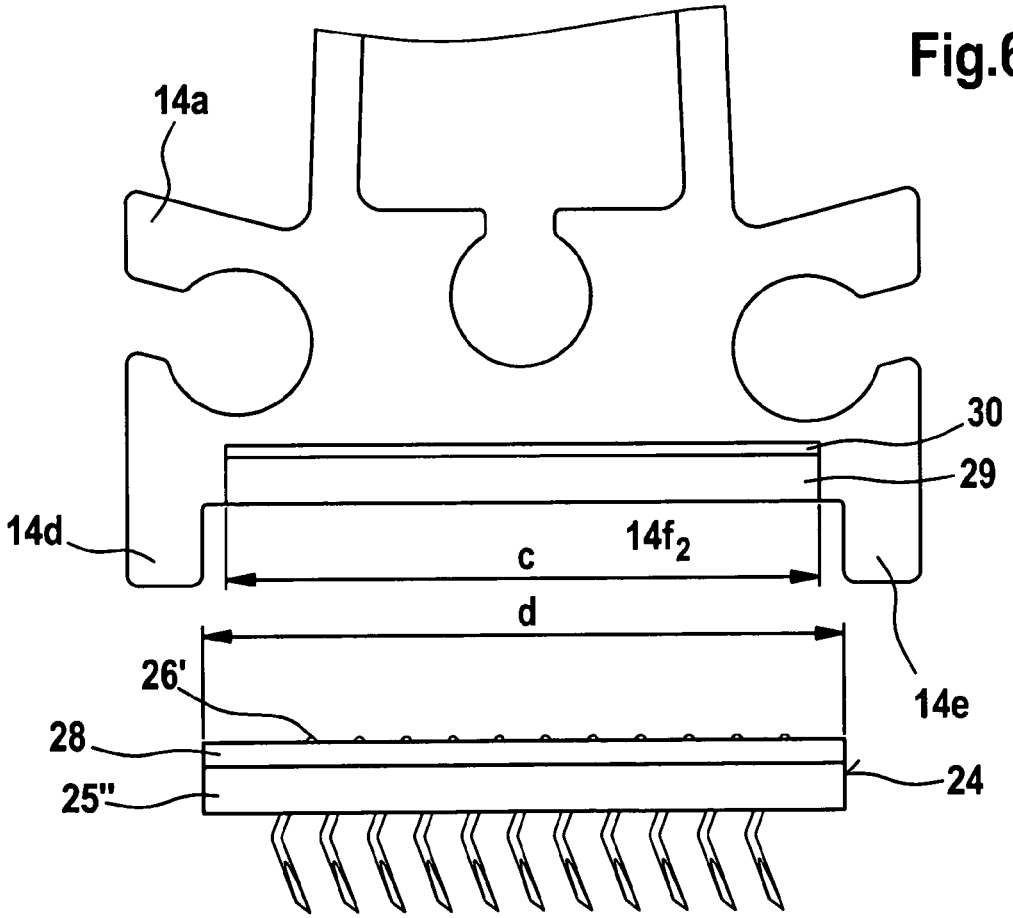
FIG. 6*b* shows a flat bar according to FIG. 6*a* but with the clothing strip detached.

In the flat bar arrangement shown in FIGS. 6*a* and 6*b*, the flat clothing 24 consists of small wire hooks 26 and supporting element 25" (see FIG. 3). FIG. 6*a* shows the flat bar 14 and the flat clothing 24 in the assembled state, in which the flat clothing, that is to say the turn regions 26' thereof, and the sheet-steel foil 28 are held so securely by the magnet 29 that, during operation, forces acting through the card on the flat clothing 24 are not capable of detaching the flat clothing 24 from the magnet 29. According to FIG. 6*b*, the flat clothing 24 has, for example in the event of wear, damage or the like to the small clothing hooks 26, been separated from the magnet 29 and removed from the recess 14*$f_2$*. Separation from the magnet 29 can be effected by a suitable tool by which the holding force of the magnet is overcome. The separation can also be carried out when the card is running, during operation, on the return transport of the flat bars (14) (see arrow $D_1$ in FIG. 1).

With the device according to the invention, the user (spinning mill) has a simple system of connection in the region of the card flat that renders possible simple and rapid re-clothing, which the user is able to carry out himself without the need for greater tool expenditure. The user, on his own judgement of the state of wear of his flat clothings, can easily replace them with elements (flat strips 24) he has in store.

The forces between flat bar 14 and adhering clothing element (flat strip 24) are appreciably increased as a result of an additional magnetic element (sheet-like structure of a ferromagnetic material) being integrated into the construction of the clothing strip (flat strip 24). The element is preferably a sheet-metal foil 28 or a woven sheet metal fabric 27, which is the uppermost layer of a "card-flat woven fabric" construction. The sheet steel foil 28 or the steel woven fabric 27 can advantageously be interwoven into clothing strips (supporting bodies 25") prior to needling, or needled together with the woven material (supporting body 25") during needling.

Although the foregoing invention has been described in detail by way of illustration and example for purposes of clarity of understanding, it will be obvious that changes and modifications may be practised within the scope of the appended claims.

What is claimed is:

1. A flexible clothing for a card flat, comprising:

an elongate supporting body;

wire clothing elements located on the supporting body; and a sheet-like structure comprising a ferromagnetic material, wherein the sheet-like structure is needled to the supporting body by the wire clothing elements piercing the sheet-like structure.

2. A flexible clothing according to claim 1, in which the sheet-like structure comprises a layer that consists essentially of the ferromagnetic material.

3. A clothing according to claim 1, in which the sheet-like structure comprises a woven fabric.

4. A clothing according to claim 1, in which the sheet-like structure comprises a film or foil.

5. A clothing according to claim 1, in which the sheet-like structure is flexible.

6. A clothing according to claim 1, in which the sheet-like structure is thin relative to the supporting body.

7. A clothing according to claim 1, in which the sheet-like structure comprises fine wires.

8. A clothing according to claim 1, in which the sheet-like structure comprises particles of a ferromagnetic material.

9. A clothing according to claim 1, in which the sheet-like structure is aligned substantially parallel to the supporting body.

10. A clothing according to claim 1, in which the sheet-like structure is integrated into the supporting body.

11. A clothing according to claim 1, in which the sheet-like structure forms an intermediate layer of the supporting body.

12. A clothing according to claim 1, in which the sheet-like structure forms a top layer of the supporting body, wherein the top layer in use faces the card flat.

13. A clothing according to claim 1, in which the sheet-like structure is interwoven into, or embedded in, the supporting body.

14. A clothing according to claim 1, in which the sheet-like structure is affixed to the supporting body.

15. A clothing according to claim 1, in which the sheet-like structure comprises a sheet-metal foil.

16. A clothing according to claim 1, in which the supporting body comprises cotton or a cotton-containing fabric, and the supporting body and the sheet-like structure are joined to one another by adhesive bonding or by sewing.

17. A clothing according to claim 1, in which the ferromagnetic material comprises steel.

18. A card comprising:

a revolving card top unit;

at least one flat bar located on the revolving card top unit;

a roller having a clothing;

a flat clothing comprising clothing elements arranged in a strip-shaped supporting body, the flat clothing attached to the flat bar opposite to the clothing of the roller, wherein the supporting body comprises a sheet-like structure comprising a ferromagnetic material that is needled to the supporting body by the clothing elements; and at least one magnetic element located between the flat bar and the flat clothing.

19. The card according to claim 18, in which the flat bar comprises an iron material.

20. The card according to claim 18, in which the magnetic element is located on or in the vicinity of a face of the flat bar that faces the clothing.

21. A flat bar for a card comprising:

a flat clothing comprising clothing elements arranged in a strip-shaped supporting body attached to the flat bar, wherein a sheet-like structure comprising a ferromagnetic material is needled to the supporting body by the clothing elements; and at least one magnetic element positioned between the flat bar and the flat clothing.

* * * * *